United States Patent [19]

Kovacs

[11] Patent Number: 4,738,392

[45] Date of Patent: Apr. 19, 1988

[54] MAILBOX WITH SIGNAL FLAGS

[76] Inventor: Elmer A. Kovacs, 2-12407-4, Swanton, Ohio 43558

[21] Appl. No.: 33,241

[22] Filed: Apr. 2, 1987

[51] Int. Cl.[4] ..... A47G 29/12

[52] U.S. Cl. ..... 232/35; 232/34

[58] Field of Search ..... 232/17, 34, 35

[56] References Cited

U.S. PATENT DOCUMENTS

| | | | |
|---|---|---|---|
| 2,352,975 | 7/1944 | Roe | 232/35 |
| 2,687,846 | 8/1954 | Chrisman | 232/35 |
| 2,852,185 | 9/1958 | Stouten | 232/35 |
| 2,905,378 | 9/1959 | Cox et al. | 232/35 |
| 2,927,727 | 3/1960 | Kreider | 232/35 |
| 2,988,268 | 6/1961 | Mioduski | 232/35 |
| 3,143,287 | 8/1964 | Hot | 232/35 |
| 3,294,057 | 12/1966 | Feil | 116/32 |
| 3,392,911 | 7/1968 | Clark | 232/35 |
| 3,602,424 | 8/1971 | Raulston | 232/35 |
| 3,815,811 | 6/1974 | Harmon | 232/35 |
| 3,960,317 | 6/1976 | Clement | 232/35 |
| 4,005,816 | 2/1977 | Malik | 232/35 |
| 4,147,292 | 4/1979 | Fisher | 232/35 |
| 4,151,949 | 5/1979 | Huebener | 232/34 |
| 4,290,549 | 9/1981 | Getz, Jr. | 232/35 |
| 4,365,740 | 12/1982 | Whitley et al. | 232/35 |
| 4,552,302 | 11/1985 | Rung | 232/35 |

*Primary Examiner*—Robert W. Gibson, Jr.

*Attorney, Agent, or Firm*—David C. Purdue; John C. Purdue

[57] ABSTRACT

A mailbox provided with a first signal flag mounted for rotation between a first position indicating the presence of mail in the box to be picked up by the mail carrier and a second, neutral position is disclosed. A flange depending from the first signal flag is adapted to frictionally engage a portion of the mailbox door when the first signal flag is in the first position thereby retaining the first signal flag in the first position. When the mailbox door is opened, for example, by a mail carrier, the frictional engagement is broken and gravity causes the first signal flag to rotate to the second, neutral position. The mailbox is provided with a second signal flag mounted for rotation between a first position indicating that a mail carrier has opened the mailbox door to insert mail and a second, neutral position. The second signal flag has a depending flange adapted to be engaged by a portion of mailbox door when the second signal flag is in the neutral position, as the mailbox door is moved from a closed position towards an open position. Continued movement of the door towards the open position causes rotation of the second signal flag to the first position where it can be frictionally held. In one embodiment, the mailbox door and the first and second signal flags are mounted for rotation about a common axis.

9 Claims, 1 Drawing Sheet

MAILBOX WITH SIGNAL FLAGS

BACKGROUND OF THE INVENTION

1. Field of the Invention

The present invention relates generally to mail boxes and, more specifically, to mail boxes provided with a pair of signal flags which, by their position, indicate whether or not there is mail left in the box by a resident or by the postman.

2. Discussion of the Prior Art

A great deal of time and effort has been devoted to designing mail boxes including one or more signal devices. Typically, such devices are flags which can be moved into and out of a position to indicate that a resident has or has not left mail in the box to be picked up and to indicate that a mailman has or has not put mail in the box. Below are listed patents disclosing such mail boxes provided with signal devices and mechanisms for automatically moving one or more signal devices into or out of a position which indicates a condition of the box.

U.S. Pat. No. 2,352,975 discloses a mailbox equipped with a flag mounted for rotation between a first position indicating that a resident has left mail in the box to be picked up and a second position indicating that there is no mail in the box to be picked up. A flange attached to the door of the mailbox is positioned to cooperate with a lower end of the flag and causes the flag to rotate from the first position to the second position when the door is opened.

U.S. Pat. No. 2,988,268 discloses a mailbox provided with a signal flag mounted for rotation between a first position indicating the presence of mail in the box to be picked up, a second, neutral position and a third position indicating the presence of mail in the box that has been delivered. A rod mounted on the door is operable to engage a portion of the flag and retain it in the first or second position when the door is closed. When the door is opened, the flag is released from the first or second position and rotated by gravity to the third position.

U.S. Pat. No. 3,143,287 discloses a mailbox equipped with a flag mounted for rotation between a first position indicating that mail has not been delivered to the box and a second position indicating that mail has been delivered to the box. A tab depending from the flag is engageable by a portion of the mailbox door to retain it in the first position until the door is opened whereupon gravity causes the flag to pivot from the first position to the second position.

U.S. Pat. No. 3,294,057 discloses a mailbox provided with a flag mounted for rotation between a first position indicating the presence in the box of mail to be picked up and a second, neutral position. An arm having a first end pivotally mounted on the flag is adapted to resiliently and releasably engage a pin attached to and extending from the mailbox door to releasably maintain the flag in the first position. When the door is opened, the arm is released from the pin on the door and the flag is rotated by gravity to the second, neutral position.

U.S. Pat. No. 3,392,911 discloses a mailbox provided with a rotatably mounted flag to indicate the presence or not of mail in the box to be picked up. A tab depending from the flag is adapted to be frictionally engaged between a portion of the door and a portion of the mailbox to retain the flag in a first position indicating the presence in the box of mail to be picked up. When the door is opened, the frictional engagement is terminated and the flag is rotated by gravity to a second, neutral position.

U.S. Pat. No. 3,602,424 discloses a mailbox with a signal flag mounted for rotation between a first, horizontal position and a second, vertical position indicating that mail has been delivered to the box. A flange depending from the mailbox door is adapted to engage one end of the flag and maintain it in a substantially horizontal position until the door is opened whereupon gravity causes the flag to rotate from the first position to the second position.

U.S. Pat. No. 3,960,317 discloses a mailbox with a hollow signal flag mounted on a flange attached to the mailbox door for rotation between a first position indicating that mail has been delivered and a second position indicating that mail has not yet been delivered. Slidable weights are disposed inside the hollow signal flag. As the mailbox door is opened, the slidable weights move within the signal flag to a position where they urge rotation of the signal flag from the second position to the first position. The slidable weights retain the signal flag in the first position even as the door of the mailbox is closed.

U.S. Pat. No. 4,005,816 discloses a mailbox having two doors. The mailbox is provided with a signal flag mounted for rotational movement between a first, neutral position and a second position indicating the presence in the box of mail which has been delivered. A linkage rod is provided to connect the front door with the signal flag and is operable to raise the signal flag as the front door is opened. A chain extends between and is connected to the signal flag and the rear door of the mail box so that upon the opening of the rear door of the mailbox to remove mail which has been delivered, the signal flag is returned to the first, neutral position.

U.S. Pat. No. 4,147,292 discloses a mailbox provided with a signal flag mounted on top of the mailbox for rotation between a first, horizonal position and a second, vertical position. When the flag is in the vertical position, a flange depending therefrom rests against the outside surface of the mailbox door, when the door is closed. When the door is opened, it acts on the depending flange to cause rotation of the signal flag from the vertical position to the horizontal position thereby indicating that mail has been delivered to the box.

U.S. Pat. No. 4,159,949 discloses a mailbox provided with two signal flags mounted at opposite ends of a signal arm which, in turn, is mounted for rotational movement between a first position where one flag is visible to indicate that mail is in the box to be picked up, a second, neutral position where neither flag is visible, and a third position where the second flag is visible to indicate the presence in the box of mail which has been delivered. The flags are manually movable between each of the three positions.

U.S. Pat. No. 4,290,549 discloses a mailbox provided with two flags mounted for rotation between a signaling position and a non-signaling position. A first flag is urged by gravity to rotate from a signaling position to a non-signaling position. A portion of the first signaling flag is engaged by a flange connecting to and extending from the mailbox door when the door is closed. When the door is opened, the engagement is eliminated and the flag is rotated to the non-signaling position. The second signal flag is weighted so that gravity urges it towards a signaling position to indicate the presence of mail in the box that has been delivered. A rod pivotally connected to the mailbox door is positioned to prevent a second signal flag from rotating to the signaling position from the non-signaling position when the mailbox door is closed. When the mailbox door is opened, the rod is moved to a position where it no longer prevents the second signal flag from rotating to the signaling position.

SUMMARY OF THE INVENTION

The present invention relates to mailboxes provided with a first signal flag mounted for rotation between a first position in which it indicates the presence of mail in the box to be picked up by the postman and a second, non-signaling position. A flange depending from the first signal flag is adapted to frictionally engage a portion of the mailbox door when the first signal flag is in the first position thereby retaining the first signal flag in the first position. When the mailbox door is opened, for example, by the postman, the frictional engagement is eliminated and gravity causes the first signal flag to rotate the second, non-signaling position.

The mailbox is provided with a second signal flag mounted for rotational movement between a first position in which it indicates that the postman has opened the mailbox door to insert mail and a second, non-signaling position. The second signal flag has a depending flange adapted to be engaged by a portion of the mailbox door when the second signal flag is in the non-signaling position and the mailbox door is moved from a closed position towards an open position. Continued movement of the door to the open position causes rotation of the second signal flag to the first position where it can be frictionally held. In a preferred embodiment, the mailbox door and the first and second signal flags are mounted for rotation about a common axis.

DETAILED DESCRIPTION OF THE INVENTION

Figure 1:
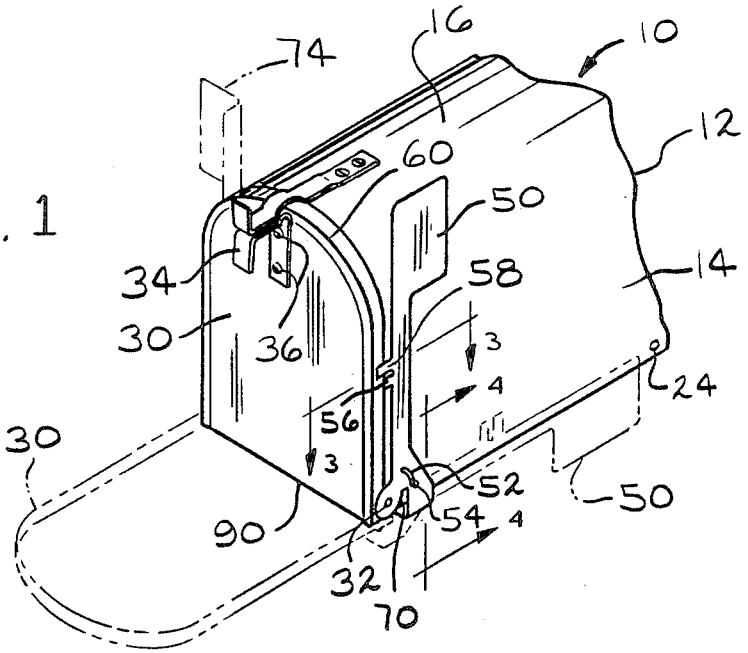
FIG. 1 is a perspective view of one side of a portion of a mailbox including signal flags according to the present invention.
Figure 4:
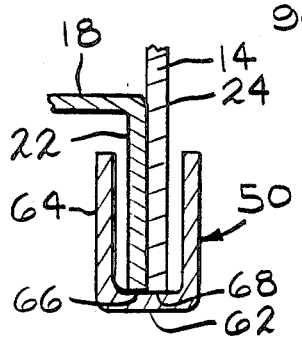
FIG. 4 is a sectional view taken along the line 4—4 of FIG. 1.

With reference to FIG. 1, a portion of a mailbox including a signal flag in accordance with the present invention is indicated generally at 10. The mailbox 10 comprises a sheet 12 having a generally U-shaped cross section. The sheet 12 constitutes sidewall portions 14 and a top wall portion 16 which, together with a floor 18 (FIG. 2) define a mail receiving cavity indicated at 20. The floor 18 includes depending flanges 22 (FIG. 4) through which the floor 18 is secured to the sidewall portions 14 by rivets 24 provided at space points along the length of each side of the mailbox 10.

Figure 2:
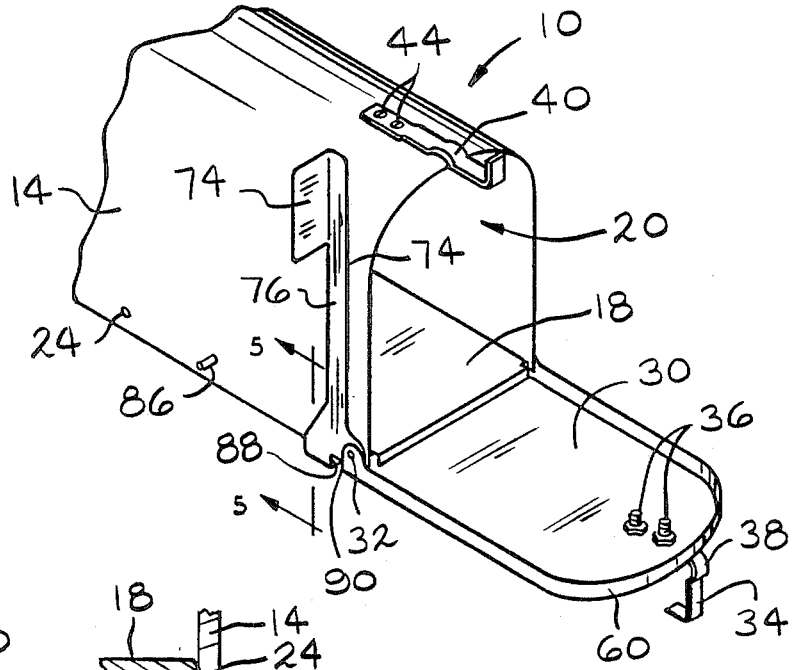
FIG. 2 is a perspective view of the other side of the portion of the mailbox shown in FIG. 1.

The mailbox 10 is provided with a door 30 which is mounted on rivets 32 for rotation, relative to the mailbox 10, between a closed position, as shown in FIG. 1, and an open position as shown in FIG. 2 and in phantom lines in FIG. 1. The door is provided with a conventional handle 34 which is secured by threaded fasteners 36 to the door 30. The handle 34 includes a detent 38 configured to engage a corresponding detent 40 provided on a latch member 42 which is secured to the top wall portion 16 of the mailbox by threaded fasteners 44. As described thus far, the mailbox 10 is conventional.

A flag 50 is mounted for rotation, relative to the mailbox 10, on the rivet 32. The flag 50 is shown in FIG. 1, in phantom lines, in a first, neutral position which is substantially horizontal. The flag 50 is shown, in solid lines, in a second position indicating the presence in the box 10 of mail (not shown) to be picked up. Clockwise rotation of the flag 50 from the first, neutral position is prevented by cooperation between a slot 52 provided in the flag 50 and a post 54 which is secured to and supported by the side wall portion 14 of the mailbox 10.

Figure 3:
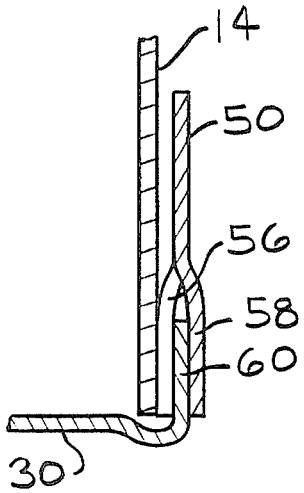
FIG. 3 is a sectional view taken along the line 3—3 of FIG. 1.

The flag 50 is provided with depending tabs 56 and 58 which are adapted to frictionally engage a portion of a peripheral flange 60 which depends from the door 30. This relationship is illustrated in FIG. 3, a sectional view taken along the line 3—3 of FIG. 1. With reference to FIG. 3, the flag 50 is in the second position and the tab 56 is disposed between a portion of the flange 60 and the side wall 14 while tab 58 is outside the flange 60. There is a frictional engagement of the flange 60 by the tabs 56 and 58. This frictional engagement retains the flag 50 in the second position so long as the door 30 remains closed. The mailbox 10 is constructed so that this frictional engagement is broken when the door 30 is rotated from the closed position (solid lines in FIG. 1) to the open position (phantom lines in FIG. 1). With the flag 50 in the second position, movement of the door 30 from the closed position towards the open position will cause a force to be exerted through the frictional engagement of the tabs 56 and 58 with the door flange 60 tending to rotate the flag 50 in a counterclockwise direction. This will be prevented by cooperation of elements shown in FIG. 4.

When the flag 50 is in the second position, a bottom portion 62 of a flange 64 which is bent to have a U-shaped cross section engages and abuts lower edges 66 and 68 of the floor flange 22 and the sidewall portion 14, respectively. This abutment prevents counterclockwise rotation of the flag 50 from the second position so that when the door 30 is moved from the closed position towards the open position, door flange 60 slides out of frictional engagement with tabs 56 and 58. Alternatively or conjunctively, counterclockwise rotation of the flag 50 from the second position may be prevented by cooperation between the slot 52 and the post 54. The flag 50 is configured so that, when it is in the second position, its center of gravity is disposed towards the rear of the mailbox from the rivet 32. Consequently, when the frictional engagement of tabs 56 and 58 with the door flange 60 is broken, the force of gravity acts on the flag 50 to cause it to rotate in a clockwise direction towards the first position shown in phantom lines in FIG. 1. Clearance is provided between the flag 50, when it is in its first position and the door 30 when it is in the open position by a slot 70 in the flag 50. Additionally, clearance is provided between the flange 64 on one hand and the floor flange 22 and the side wall portion 14 on the other hand.

A second flag 74 is mounted for rotation, relative to the mailbox 10, by a rivet 32. The flag 74 has a configuration which is similar to that of the flag 50 with the following exceptions. Flag 74 is not provided with slots corresponding with the slot 52 or the slot 70 provided in the flag 50. Additionally, the flag 74 comprises a stem 76 and a flag portion 78 having major surfaces which are roughly perpendicular. This is to provide increased visibility of the second flag 74 to a resident of a dwelling located substantially behind the mailbox 10. Finally, the second flag 74 includes a flange portion 80 which is bent to have a substantially U-shaped cross section having opposed side walls 82 and 84 adapted to frictionally engage the sides of the floor flange 22 and the side wall portion 14 whereas the bent flange 64 on flag 50 is configured to provide clearance between it and floor flange 22 and side wall portion 14.

Figure 5:
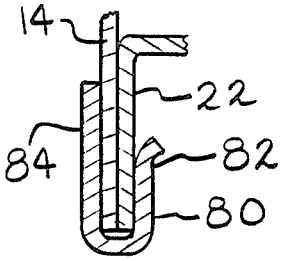
FIG. 5 is a sectional view taken along the line 5—5 of FIG. 2.

The second flag 74 is mounted for rotation between a first, neutral, substantially horizontal position (not shown) where the flag stem 76 rests on a post 86 and a second, substantially vertical position shown in FIG. 1 in phantom lines and in FIG. 2 in solid lines indicating the presence of mail in the mail receiving cavity 20. The flag 74 is adapted to be positioned in the first, neutral position by a resident upon removing mail from the mail receiving cavity 20 and closing the door 30. The flag 74 has a shoulder 88 located in a position corresponding with the slot 70 in the flag 50. This shoulder is adapted to abut with a lower edge 90 of the door 30 when the angular displacement between the flag stem 76 and the door 30 approaches 90° from an angular displacement of less than 90°. Consequently, when the door 30 is closed and the flag 74 is in the first, neutral, substantially horizontal position, and there is an angular displacement therebetween of slightly less than 90°, a slight rotation of the door 30 from the closed position towards the open position will result in abutment between the shoulder 88 of the flag 74 and the lower edge 90 of the door 30. (In FIG. 2, for purposes of illustration, a small gap is shown between the shoulder 88 and the edge 90. Actually, with the flag 74 and the door 30 in the positions illustrated in FIG. 2, shoulder 88 would be in contact with the lower edge 90 of the door 30.) Continued rotation of the door 30 toward the open position will cause rotation of the flange 74 about the rivet 32 from the first, neutral position toward the second position. When the door 30 reaches the open position illustrated in FIG. 2, the flag 74 will be in the position illustrated in FIG. 2 and the side walls 82 and 84 of the flange 80 will be frictionally engaged with the floor 22 and the side wall portion 14 as illustrated in FIG. 5. If the door 30 is closed at this point, the flag 74 will remain in the second position by virtue of the frictional engagement of the elements shown in FIG. 5. One can break the frictional engagement by merely grasping a portion of the flag 74 and rotating it about the rivet 32 toward the first, neutral position where it will remain until the door 30 is opened again.

The operation of the mailbox 10 will now be described in the case where a resident desires to indicate to a mail carrier that there is mail to be picked up as well as in the case where a resident does not desire to indicate the presence of mail to be picked up. In both cases, the operation will be described starting with the flags 50 and 74 each in the first, neutral, substantially horizontal position.

If a resident desires to indicate to a mail carrier that there is mail in the mailbox 10 to be picked up, the resident puts the mail in the mail receiving cavity 20 of the mailbox 10, closes the door 30 and manually pivots the flag 50 from the first, neutral position to the second, signalling position. The resident, in rotating the flag 50, will cause the depending tabs 56 and 58 to engage the door flange 60. This frictional engagement will retain the flag 50 in the second, signalling position so long as the door 30 remains closed. Eventually, a mail carrier will arrive at the box and pivot the door 30 from the closed position to the open position. This action will have two consequences. First, it will break the frictional engagement between the depending tabs 56 and 58, on the one hand and the door flange 60, on the other hand. With the frictional engagement broken, gravity will cause the flag 50 to rotate from the second, signalling position to the first, neutral position. Second, the lower edge 90 of the door 30 will engage the shoulder portion 88 of the flag 74 so that rotation of the door from the closed position to the open position will cause a corresponding rotation of the flag 74 from the first, neutral position to the second, signalling position where it will be held by frictional engagement between portions of the flange 80, on the one hand, and the floor flange 22 and side wall 14, on the other hand. In the second, signalling position, the flag 74 will signal to a resident that a mail carrier has visited the box 10 and that a trip to the box 10 would not be wasted. On arriving at the box 10, a resident would open the door 30, remove any mail left by the mail carrier, close the door 30 and manually rotate the flag 74 to the first, neutral position where it will remain until the door 30 is opened again.

In the case where a resident does not leave mail in the box 10 to be picked up, the flag 50 will be in the first, neutral position. When a mail carrier opens the door 30, the lower edge 90 of the door 30 will enter the slot 70 provided in the flag 50 which will remain in the first, neutral position. The sequence of events described above with respect to the flag 74 will be the same in this case.

Thus it will be seen that the present invention provides an elegantly simple signal flag arrangement for a mailbox for signalling (1) the presence or not of mail in the box to be picked up by the mail carrier and (2) whether or not a mail carrier has visited the mailbox. The first signal flag is mounted so that, when a mail carrier opens the door of the mailbox to pick up mail left there by a resident, the flag will automatically return to a non-signalling position. The second signal flag is mounted so that, when a mail carrier visits the box and opens the door, the second signal flag will automatically be rotated from a non-signalling position to a signalling position indicating the visited status of the mailbox. Thus, the mailbox of the present invention provides benefits to mail carriers and residents alike.

The foregoing detailed description is intended to enable those skilled in the art to practice the invention and not to limit it. Indeed, it will be apparent to those skilled in the art that the present invention is susceptible of numerous modifications which are not discussed above but, nevertheless, fall within the spirit and scope of the appended claims.

I claim:

1. A mailbox comprising, a housing having an open forward end, side and top wall portions and a floor defining a mail receiving cavity, a door hinged at its lower end for rotation about an axis between a first, closed position and a second, open position, a first signal flag mounted on the mailbox for rotation about said axis between a first, mail-in-box position and a second, no mail-in-box position, first latch means integral with said first signal flag, said last-named means being operable, when said first signal flag is moved from the second position to the first position to retain said first signal flag in said first position until the door is rotated from the first position, whereupon said first signal flag is rotated by gravity from said first position to said second position, a second signal flag mounted on the mailbox for rotation about said axis between a first, not visited position and a second, visited position, edge means integral with said door, said last-named means being operable, as said door is rotated from the first position to the second position, to engage a portion of said second signal flag and to cause rotation thereof from said first position to said second position, and second latch means for retaining said second signal flag in the second position when said door is rotated from the second position.

2. A mailbox as claimed in claim 1 wherein said first latch means comprise depending tabs adapted to frictionally engage a portion of said door when said door is in the first position.

3. A mailbox as claimed in claim 1 wherein said second latch means comprise a flange depending from said second signal flag, said flange being configured to frictionally engage a portion of the mailbox when said second signal flag is in the second position.

4. A mailbox comprising, a housing having an open forward end, side and top wall portions and a floor defining a mail receiving cavity, a door hinged at its lower end for rotation between a first, closed position and a second, open position, a first signal flag mounted on the mailbox for rotation between a first, mail-in-box position and a second, no-mail-in-box position, at least one tab depending from said first signal flag adapted to enter into frictional engagement with a portion of said door when it is in the first position and said first signal flag is in said first position, stop means for preventing rotation of the first signal flag from the second position past said first position, a second signal flag mounted on the mailbox for rotation between a first, not visited position and a second, visited position, a shoulder provided on said second flag configured and positioned so that when said second flag is in the first position, said shoulder is engaged by a portion of said door when it is rotated from the first position to the second position so that this rotation is transmitted to the second signal flag causing it to rotate from the first position to the second position and a tab depending from said second signal flag configured to frictionally engage a portion of a mailbox when said second signal flag is in the second position, thereby frictionally retaining said second signal flag in said second position.

5. A mailbox as claimed in claim 4 wherein said door and said first signal flag are mounted for rotation about a common axis.

6. A mailbox as claimed in claim 5 wherein said second signal flag is mounted for rotation about said axis.

7. A mailbox as claimed in claim 4 wherein said door and said second signal flag are mounted for rotation about a common axis.

8. A mailbox as claimed in claim 7 wherein said first signal flag is mounted for rotation about said axis.

9. A mailbox as claimed in claim 4 wherein said door, said first signal flag and said second signal flag are mounted for rotation about a common axis.

* * * * *